US008096000B2

(12) United States Patent
Helmetsie et al.

(10) Patent No.: US 8,096,000 B2
(45) Date of Patent: Jan. 17, 2012

(54) CONFIGURABLE MODULAR SHOWER SURROUND FEATURES

(75) Inventors: Eugene A. Helmetsie, Spencer, NY (US); Harper F. Zarker, Jr., Lumberton, NJ (US); Tomasz Pracel, Spencer, NY (US)

(73) Assignee: American Shower & Bath Corporation, Moorestown, NJ (US)

( * ) Notice: Subject to any disclaimer, the term of this patent is extended or adjusted under 35 U.S.C. 154(b) by 1196 days.

(21) Appl. No.: 10/774,339

(22) Filed: Feb. 6, 2004

(65) Prior Publication Data

US 2005/0172395 A1 Aug. 11, 2005

(51) Int. Cl.
*A47K 3/00* (2006.01)

(52) U.S. Cl. ..... 4/614; 4/612

(58) Field of Classification Search ..... 4/596, 597, 4/605, 607, 609–612, 614; D23/275, 283, D23/304, 305; D6/562; 248/235, 231.9, 248/250, 220.1, 71; 312/242, 245; 211/86.01, 211/87.01, 88.01, 90.01, 90.04, 126.1, 134, 211/153, 187, 190; 108/96, 107, 152, 108–110
See application file for complete search history.

(56) References Cited

U.S. PATENT DOCUMENTS

| | | | | | |
|---|---|---|---|---|---|
| 1,059,464 | A | * | 4/1913 | Hine | 108/107 |
| 2,036,184 | A | * | 4/1936 | Armstrong | 108/101 |
| 4,319,792 | A | * | 3/1982 | Britt et al. | 312/245 |
| D284,689 | S | * | 7/1986 | King et al. | D23/304 |
| 4,718,131 | A | * | 1/1988 | Kitamura et al. | 4/663 |
| 4,886,236 | A | * | 12/1989 | Randall | 248/250 |
| 5,070,549 | A | * | 12/1991 | Campe | 4/596 |
| 5,329,650 | A | * | 7/1994 | Zaccai et al. | 4/605 |
| D380,528 | S | * | 7/1997 | D'Andrea | D23/283 |
| D383,198 | S | * | 9/1997 | Jacuzzi et al. | D23/275 |
| 5,768,721 | A | * | 6/1998 | Kersten | 4/614 |
| D405,517 | S | * | 2/1999 | Eeckhoudt | D23/283 |
| D445,491 | S | * | 7/2001 | Paredes | D23/305 |

FOREIGN PATENT DOCUMENTS

| | | | |
|---|---|---|---|
| EP | 0348653 | A1 * | 1/1990 |
| EP | 0415058 | A2 * | 3/1991 |

* cited by examiner

*Primary Examiner* — Huyen Le
(74) *Attorney, Agent, or Firm* — Carlson Gaskey & Olds, P.C.

(57) ABSTRACT

A molded shower surround provides a base portion that receives wall portions and a corner portion. The corner portion includes a multiple of features such that the shower surround may be particularly tailored to customers' desires.

14 Claims, 6 Drawing Sheets

CONFIGURABLE MODULAR SHOWER SURROUND FEATURES

BACKGROUND OF THE INVENTION

The present invention relates to a molded plastic shower surround, and more particularly to features therefore which may be assembled in a modular manner so as to provide a multiple of configurations.

Conventional modular tub/shower units often include a base portion at the bottom and a multiple of wall portions. The structure is mounted adjacent a wall or corner to form a waterproof surround. The fully enclosed waterproof structure is highly advantageous in that it prevents the escape of water into the wall cavity despite the shower spraying water onto the surrounding walls.

One problem that arises with products of this type is the uniformity of the shower surround design. Conventional shower surrounds are manufactured of large components, which provide certain features such as shelves molded directly into the structure. Each shower surround is of a particular aesthetic design having particular features that cannot be changed. The only alternative is to install a completely different shower surround that may or may not have every feature desired by a customer.

Accordingly, it is desirable to provide a molded shower surround that is assembled in a modular manner so as to provide a multiple of configurations yet is uncomplicated to assemble and aesthetically pleasing.

SUMMARY OF THE INVENTION

A molded shower surround according to the present invention provides a base portion, which receives wall portions and a corner portion. The corner portion includes a multiple of features such that the shower surround may be particularly tailored to customers' desires. The corner portion supports a canopy overhead spray head, a multiple of removable shelves, and an integral light and a seat or footrest. As the corner portion is readily integrated with a variety of wall portions, numerous features may be selectively incorporated into the shower surround. Interfaces for the removable shelves provide still further variation to the aesthetic appearance.

The present invention therefore provides a molded shower surround, which is assembled in a modular manner so as to provide a multiple of configurations yet is uncomplicated to assemble and aesthetically pleasing.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
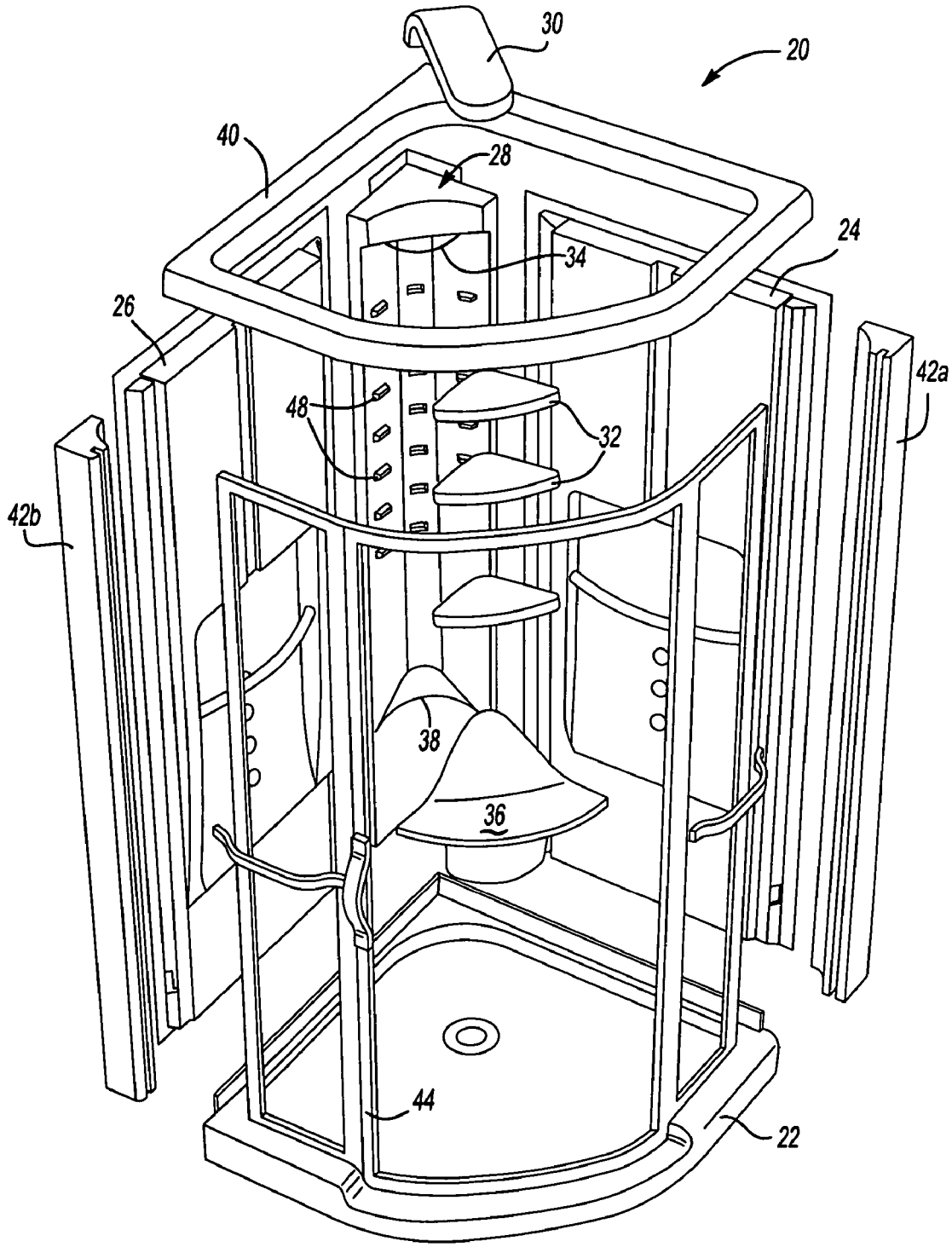
FIG. 1 is a general exploded view of a molded shower surround according to the present invention.

FIG. 1 illustrates a general exploded view of a molded shower surround 20 which is formed of a multiple of molded plastic portions. A base portion 22 receives wall portions 24 and 26 and a corner portion 28 therebetween. It should be understood that any number of wall portions will benefit from the present invention. As is evident in FIG. 1, the base portion 22 includes a flange that runs along both sides of the back corner of the base portion 22 and that is located adjacent to the wall portions 24 and 26 when the base portion 22 receives the wall portions 24 and 26. For further understanding of other assembly aspects of the shower surround and associated components thereof, attention is directed to U.S. patent application Ser. No. 10/693,616, entitled SHOWER SURROUND STRUCTURE, filed Oct. 24, 2003, which is assigned to the assignee of the instant invention and which is hereby incorporated herein in its entirety. It should be understood that although a particular component arrangement is disclosed in the illustrated embodiment, other arrangements will benefit from the instant invention.

Figure 5A:
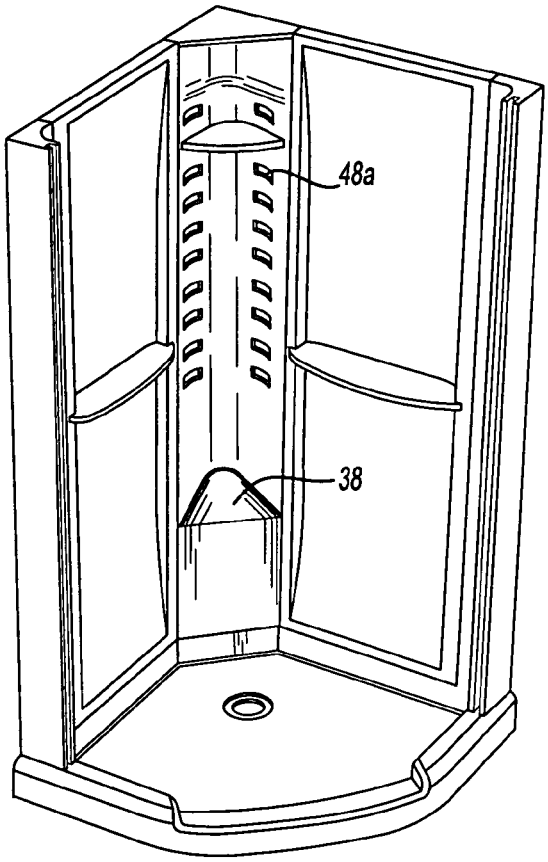
FIG. 5A is a perspective view of another corner portion of a molded shower surround.
Figure 5B:
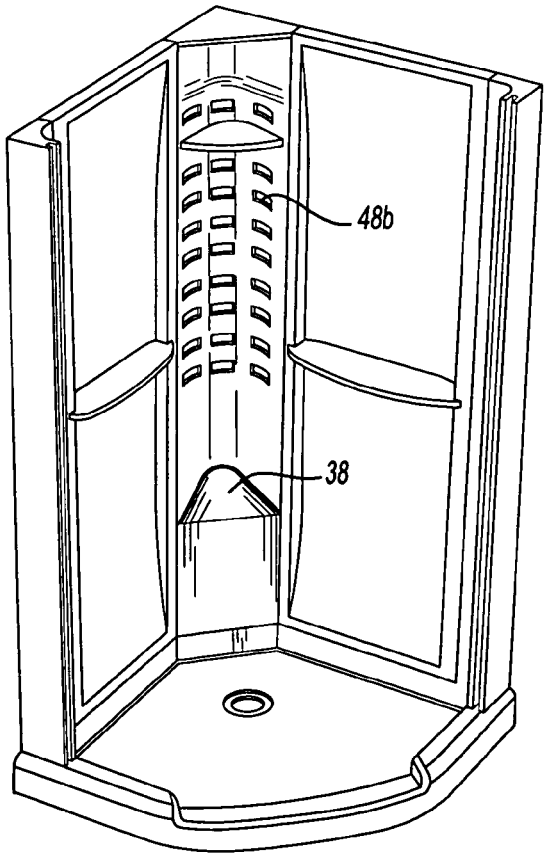
FIG. 5B is a perspective view of another corner portion of a molder shower surround.

The corner portion 28 includes a multiple of features such that the shower surround may be particularly tailored to customers' desires. The corner portion 28 preferably supports a canopy overhead spray head 30, a multiple of removable shelves 32, an integral light 34 and a seat 36 (FIG. 2) or footrest 38 (FIG. 5A-5B).

Figure 4:
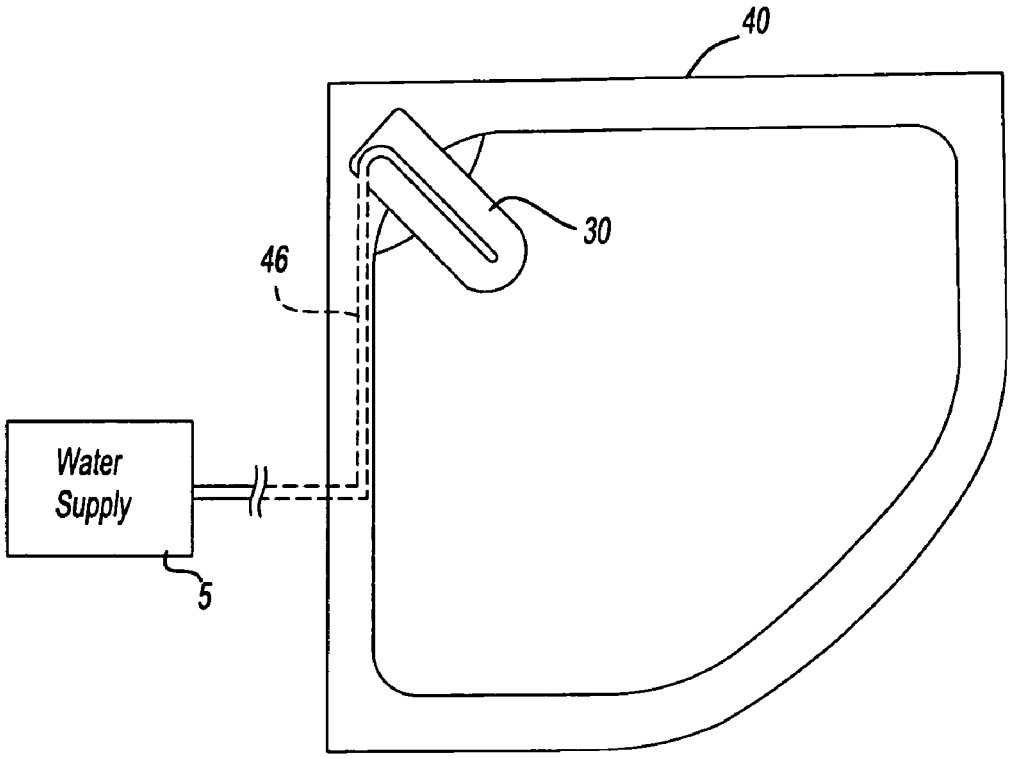
FIG. 4 is a top view of a top trim of a molded shower surround.

The canopy overhead spray head 30 extends from a top trim 40 which mounts atop the wall portions 24 and 26, the corner portion 28, end trim pieces 42*a*, 42*b* and a glass framework 44. The top trim 40 is generally hollow and rectilinear in cross-section (FIG. 4) such that a water conduit 46 is communicated therethrough to supply the shower head 30. As the top trim 40 is hollow the water conduit 46 is readily connected to a supply (illustrated schematically at S) by running the water conduit 46 through the top trim 40 in a path determined during installation. A relatively uncomplicated plumbing arrangement is thereby provided.

As the corner portion 28 is readily integrated with the wall portions 24, 26 numerous features may be incorporated into the shower surround by selecting a desired corner portion 28. Preferably, the corner portion 28 includes a multiple of horizontal shelf slots 48 arranged vertically along a length of the corner portion 28 which are available to receive the removable shelves 32. The interfaces between the slots 48 and shelves 32 are preferably of a "snap-in" (FIG. 6) or other arrangement that retains the shelves without fasteners for relatively simple mounting. It should be understood that numerous known interfaces will benefit from the present invention and that one of ordinary skill in the art and in possession of the teaching herein can readily provide such an interface.

Figure 5C:
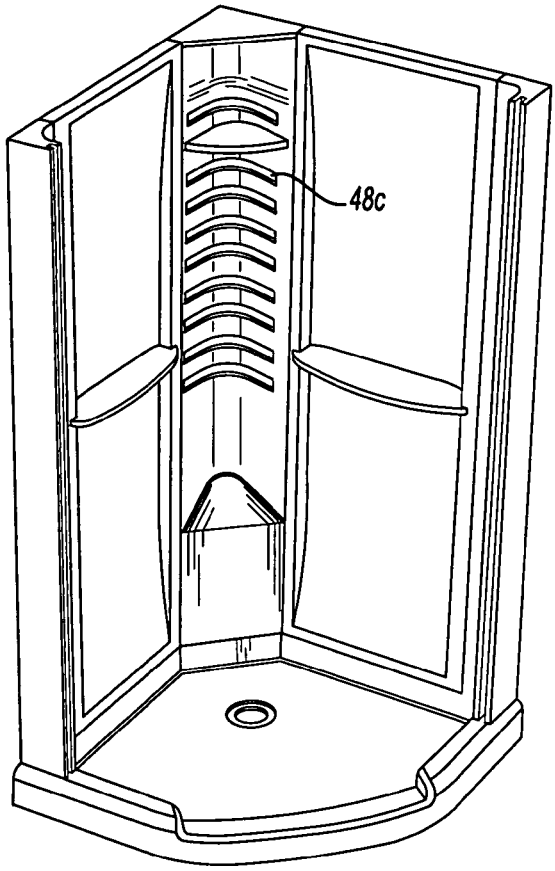
FIG. 5C is a perspective view of another corner portion of a molder shower surround.
Figure 5D:
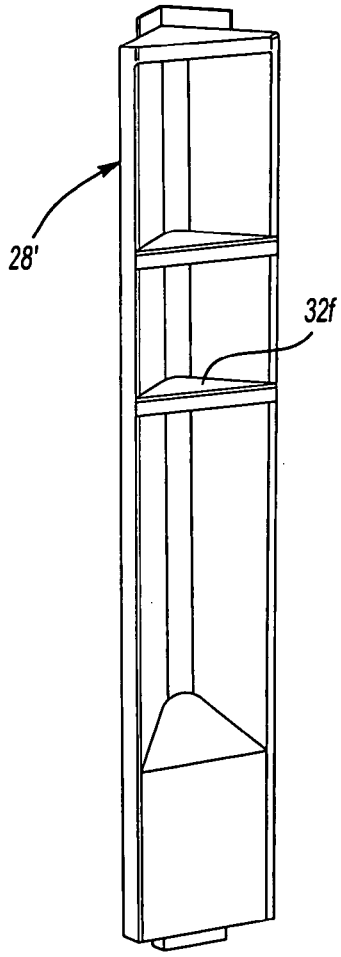
FIG. 5D is a perspective view of another corner portion of a molder shower surround.

Moreover, the various interfaces between the slots 48 and shelves 32 provide a particular aesthetic appearance. Preferably, the slots 48 are segmented (FIGS. 5A, 5B, 5C) to provide a particular appearance. Alternatively, fixed shelves 32F may be directly molded into the corner portion 28' (FIG. 5D).

Figure 2:
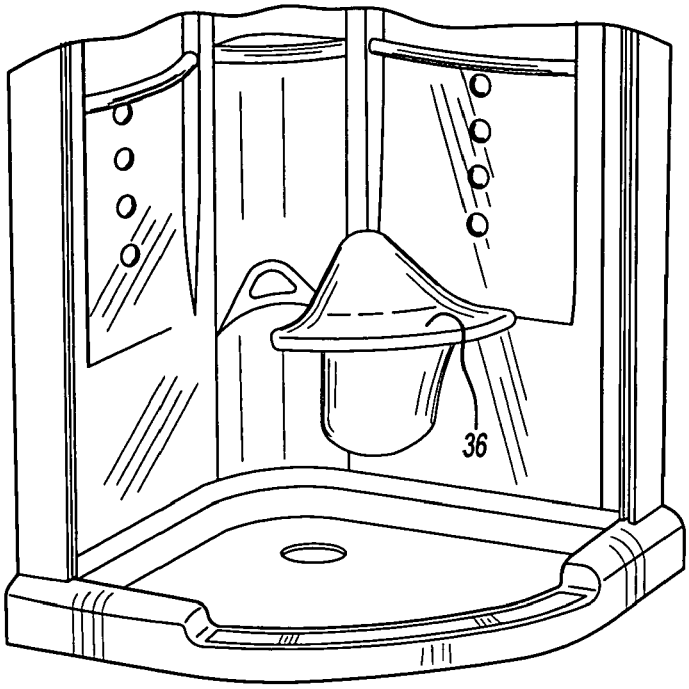
FIG. 2 is an expanded top view of a molded shower surround with a seat installed.
Figure 3:
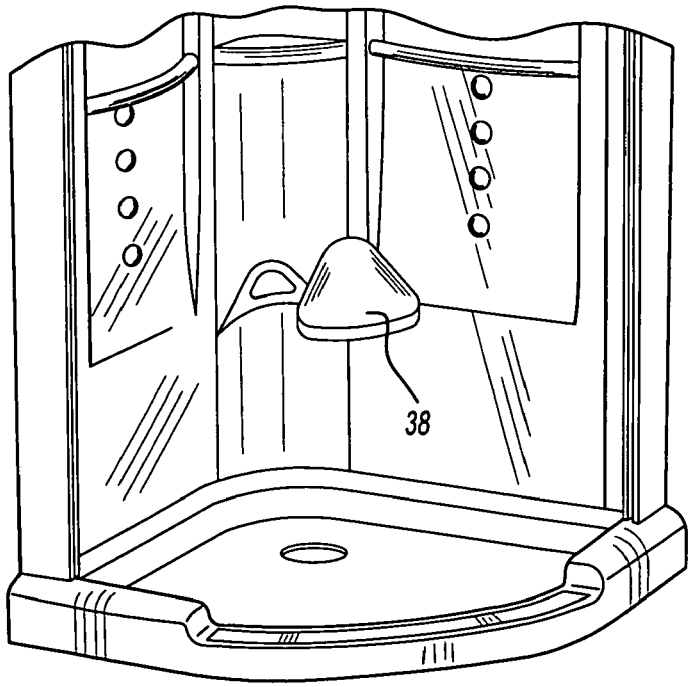
FIG. 3 is an expanded top view of a molded shower surround with a foot rest.

The footrest 38 is preferably integrally molded into the corner portion 28 while the seat 36 is selectively attached to the footrest 38 as described with regard to the shelves 32. It should be understood that the footrest 38 may include a removable footrest pad 38 (FIG. 3) or removable seat section 36 (FIG. 2). It should be understood that numerous known interfaces will benefit from the present invention and that one of ordinary skill in the art and in possession of the teaching herein can readily provide such a seat interface.

Figure 6:
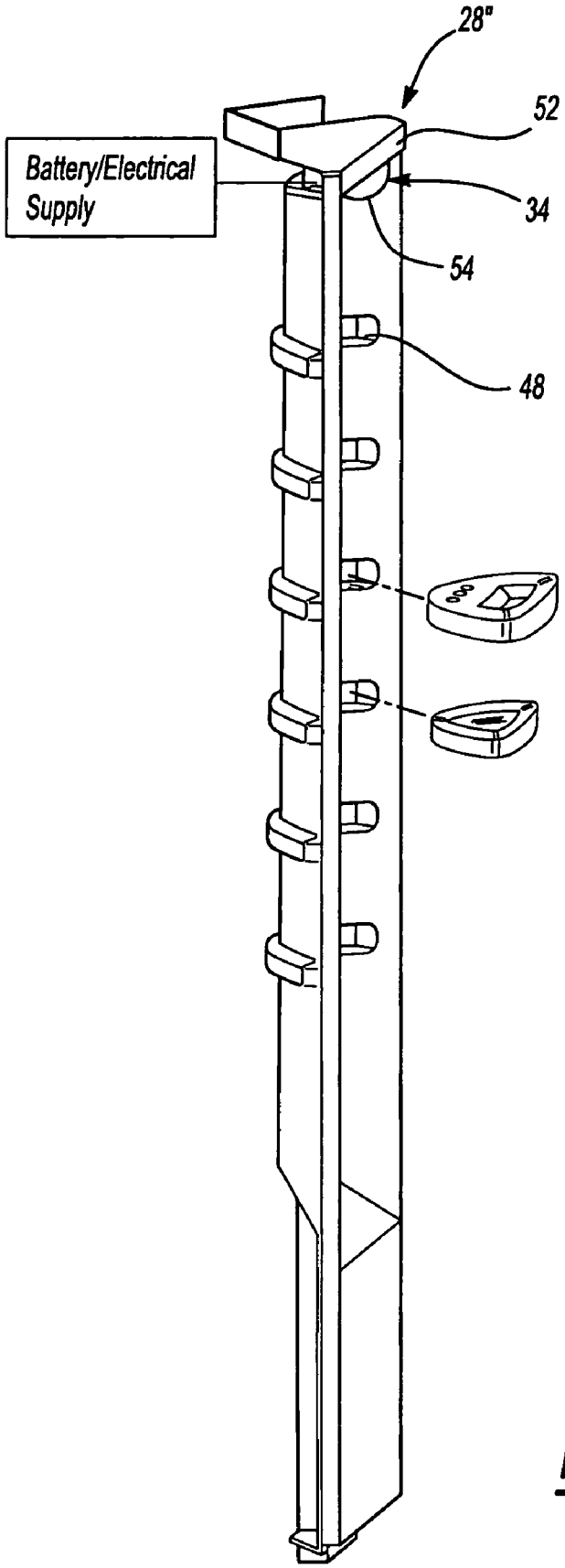
FIG. 6 is an exploded view of a corner portion with removable shelves.

Referring to FIG. 6, another corner portion 28" includes the integral light 34. The integral light 34 is preferably located above the shelf slots 48 and under a molded relief 52 which contains a lens 54 for the light 34.

It should be understood that relative positional terms such as "forward," "aft," "upper," "lower," "above," "below," and the like are with reference to the normal operational attitude and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A shower surround comprising:

a base portion;

a first wall portion;

a second wall portion; and a corner portion engaged with said base portion, said first wall portion and said second wall portion, said corner portion comprising a multiple of horizontal shelf slots arranged vertically along a length of said corner portion, wherein said horizontal shelf slots comprise blind openings of uniform height that extend into said corner portion to support a corresponding multiple of shelves, wherein the base portion receives the first wall portion, the second wall portion, and the corner portion.

2. The shower surround as recited in claim 1, wherein at least one of said horizontal shelf slots is defined by a top wall, a bottom wall facing toward said top wall, a rear wall and an open front side.

3. The shower surround as recited in claim 2, wherein said at least one of said horizontal shelf slots includes a uniform nominal depth extending into said corner portion between end portions of said horizontal shelf slots.

4. The shower surround as recited in claim 3, wherein said uniform nominal depth is defined as the distance between said rear wall and said open front side.

5. The shower surround as recited in claim 2, wherein said corner portion, said top wall, said bottom wall, and said rear wall comprise a single, continuous piece.

6. The shower surround as recited in claim 1, wherein each one of said horizontal shelf slots is adapted to support one of said corresponding multiple of shelves.

7. The shower surround as recited in claim 2, wherein said uniform height is defined as the distance between said top wall and said bottom wall.

8. The shower surround as recited in claim 1, wherein said horizontal shelf slots comprise curved openings.

9. The shower surround as recited in claim 1, wherein each of said multiple of horizontal shelf slots includes multiple segments that are horizontally arranged.

10. The shower surround as recited in claim 1, further comprising a flange extending from the base portion, the flange being located adjacent to the first wall portion and the second wall portion.

11. The shower surround as recited in claim 1, further comprising a top trim engageable with said corner portion, said first wall portion, and said second wall portion.

12. The shower surround as recited in claim 11, further comprising a shower head mounted to said top trim.

13. The shower surround as recited in claim 12, further including a water conduit connecting a water supply to the shower head, the water conduit extending behind a forward-facing portion of at least one of the first wall portion or the second wall portion such that the water conduit is not visible within the shower surround.

14. The shower surround as recited in claim 1, wherein the horizontal shelf slots form protrusions on a rear side of the corner portion.

* * * * *